US010640955B2

(12) United States Patent
Kennedy

(10) Patent No.: US 10,640,955 B2
(45) Date of Patent: May 5, 2020

(54) CAPTURE NOZZLE HOUSING FOR FIRE HYDRANT NOZZLE

(71) Applicant: Kennedy Valve Company, Elmira, NY (US)

(72) Inventor: Paul Kennedy, Horseheads, NY (US)

(73) Assignee: Kennedy Valve Company, Elmira, NY (US)

( * ) Notice: Subject to any disclaimer, the term of this patent is extended or adjusted under 35 U.S.C. 154(b) by 361 days.

(21) Appl. No.: 15/254,194

(22) Filed: Sep. 1, 2016

(65) Prior Publication Data

US 2018/0058613 A1 Mar. 1, 2018

(51) Int. Cl.
*E03B 9/04* (2006.01)
*B05B 1/00* (2006.01)

(52) U.S. Cl.
CPC . *E03B 9/04* (2013.01); *B05B 1/00* (2013.01)

(58) Field of Classification Search
CPC ..... E03B 9/04; F16L 15/008
USPC ..... 137/279; 285/336, 347, 355, 379, 374
See application file for complete search history.

(56) References Cited

U.S. PATENT DOCUMENTS 543,871 A * 8/1895 Houze ..... F16L 37/20 285/347
1,396,452 A * 11/1921 Moesmer ..... F16L 15/008 285/347
2,114,771 A * 4/1938 Turner ..... F16L 19/075 285/354
2,525,799 A * 10/1950 Hecker ..... F16L 29/00 285/347
2,661,965 A * 12/1953 Parmesan ..... F16L 19/0212 285/347
2,867,463 A * 1/1959 Snider ..... F16L 19/0218 285/336
3,963,218 A * 6/1976 Glaesener ..... E01F 15/0453 256/13.1
4,083,377 A * 4/1978 Luckenbill ..... E03B 9/04 137/296
4,141,574 A * 2/1979 Stansifer ..... E03B 9/02 137/296
4,278,276 A * 7/1981 Ekman ..... F16L 37/088 285/354

(Continued)

FOREIGN PATENT DOCUMENTS

DE 102013018174 A1 * 6/2015 ..... F16L 15/008
EP 3101324 A1 * 12/2016 ..... F16L 15/008

(Continued)

*Primary Examiner* — David Bochna
(74) *Attorney, Agent, or Firm* — Brown & Michaels, PC

(57) ABSTRACT

A novel hose nozzle has a cup shaped capture nozzle housing with a curved shape similar to the mating O-ring. The cup shaped ends of the nozzle create a 45 degree angle. The novel shape of the ends of the nozzle traps the O-ring at the same radius of the O-ring. Rounding off the end of the nozzle permit the ends to have a radius equivalent to the O-ring. The O-ring is aligned with the nozzle, because there is no longer a round item trying to fit onto a flat surface. This design stabilizes the end of the nozzle, and keeps the nozzle from becoming crooked. The mating surfaces between the nozzle cup and the O-ring are the same. The O-ring mating surface has a complementary shape to the nozzle mating surface and the radius at the end of the nozzle preferably matches the radius of the O-ring.

7 Claims, 6 Drawing Sheets

(56) References Cited

U.S. PATENT DOCUMENTS

| | | | | | |
|---|---|---|---|---|---|
| 4,353,580 | A * | 10/1982 | Houck | F16L 25/12 | 285/354 |
| 4,402,531 | A * | 9/1983 | Kennedy, Jr. | F16L 55/1152 | 285/376 |
| 4,790,341 | A * | 12/1988 | Laurel | E03B 9/04 | 137/272 |
| 7,810,851 | B2 * | 10/2010 | Wangsgaard | F16L 15/08 | 285/354 |
| 8,534,467 | B2 * | 9/2013 | Haas | B01D 29/96 | 285/354 |
| 2002/0171243 | A1 * | 11/2002 | Jost | F16J 15/028 | 285/354 |
| 2008/0245420 | A1 * | 10/2008 | Davidson | A62C 35/20 | 137/296 |
| 2015/0307378 | A1 * | 10/2015 | Barrett | C02F 1/70 | 210/198.1 |
| 2015/0330062 | A1 * | 11/2015 | Hoogerhyde | F16L 21/08 | 137/299 |

FOREIGN PATENT DOCUMENTS

| | | | | |
|---|---|---|---|---|
| FR | 77719 E | * | 4/1962 | F16L 15/008 |
| FR | 1412944 A | * | 10/1965 | F16L 15/008 |

* cited by examiner

CAPTURE NOZZLE HOUSING FOR FIRE HYDRANT NOZZLE

BACKGROUND OF THE INVENTION

Field of the Invention

The invention pertains to the field of fire hydrants. More particularly, the invention pertains to improved nozzle seals on fire hydrants.

Description of Related Art

Prior art hose nozzles on fire hydrants include a triangular chamfer and an O-ring or other seal. FIG. 4 shows a prior art hose nozzle 110 with a triangular chamfer 9 at its ends. The nozzle 110 also includes threads 41 and a nozzle retaining screw 68.

Due to the shape of the chamfer 9, the O-ring (not shown) is squeezed into a triangular shape. When putting any bias on the nozzle 110, the nozzle 110 has a tendency to slide because of the 45 degree angle of the chamfer 9. If the nozzle is put on crooked, the O-ring ends up being tangent to the nozzle 110 and the nozzle 110 is cocked with respect to the rest of the hydrant. As a result, the O-ring is unable to align with the end of the nozzle 110.

SUMMARY OF THE INVENTION

A hose nozzle for a fire hydrant including at least one O-ring comprises a cylindrical housing including a plurality of threads in proximity to a first end of the housing and a curved second end, wherein a radius of the curved second end matches a radius of the O-ring such that a first mating surface of the curved second end is complementary to a second mating surface of the O-ring. In one preferred embodiment, the radius is approximately 0.105 inches. In another preferred embodiment, a center of a curve of the curved second end forms a 45 degree angle with respect to a top of the curve of the curved second end.

DETAILED DESCRIPTION OF THE INVENTION

A novel hose nozzle has a cup shaped capture nozzle housing with a curved shape similar to the mating O-ring.

This O-ring capture nozzle housing is preferably used on a fire hydrant. The fire hose is threaded onto the nozzle, preferably with a ¼ turn socket. Lugs in the nozzle have a pitch, fit into two slots in the socket and follow a groove.

The cup shaped ends of the nozzle have a 45 degree angle, measured as the angle between a center of the curve of the end of the nozzle and a top of the curve. If any bias is put on the nozzle, a side load is created. The ends of the nozzle slide on the O-ring, which is in the corners of the nozzle. There is some clearance so the nozzle can rock.

The novel shape of the ends of the nozzle traps the O-ring at the same radius of the O-ring. The O-ring is automatically aligned with the nozzle. The end of the nozzle is rounded off, such that the end has a radius equivalent to the O-ring. With the O-ring and the nozzle cup having the same radius, the only way to get the O-ring to move would be to shear the O-ring in half. The novel shape of the end of the nozzle eliminates the need to worry about the movement of the O-ring with respect to the nozzle, or the elements coming together and being crooked.

Since there is no longer a round item trying to fit onto a flat surface, the nozzle cannot be installed in a crooked manner. It should be noted that by avoiding sharp corners on the nozzle housing, the O-ring is less likely to shred.

The present invention stabilizes the end of the nozzle, and aids in preventing the nozzle from being crooked. In one embodiment, the mating surfaces between the nozzle cup and the O-ring are the same and the radius at the end of the nozzle preferably matches the radius of the O-ring. In an alternate embodiment, the O-ring mating surface has a complementary shape to the nozzle mating surface and the radius at the end of the nozzle preferably matches the radius of the O-ring.

FIGS. 1A-1E show a hose nozzle 48 with a cup shaped capture nozzle housing 39.

Figure 1A:
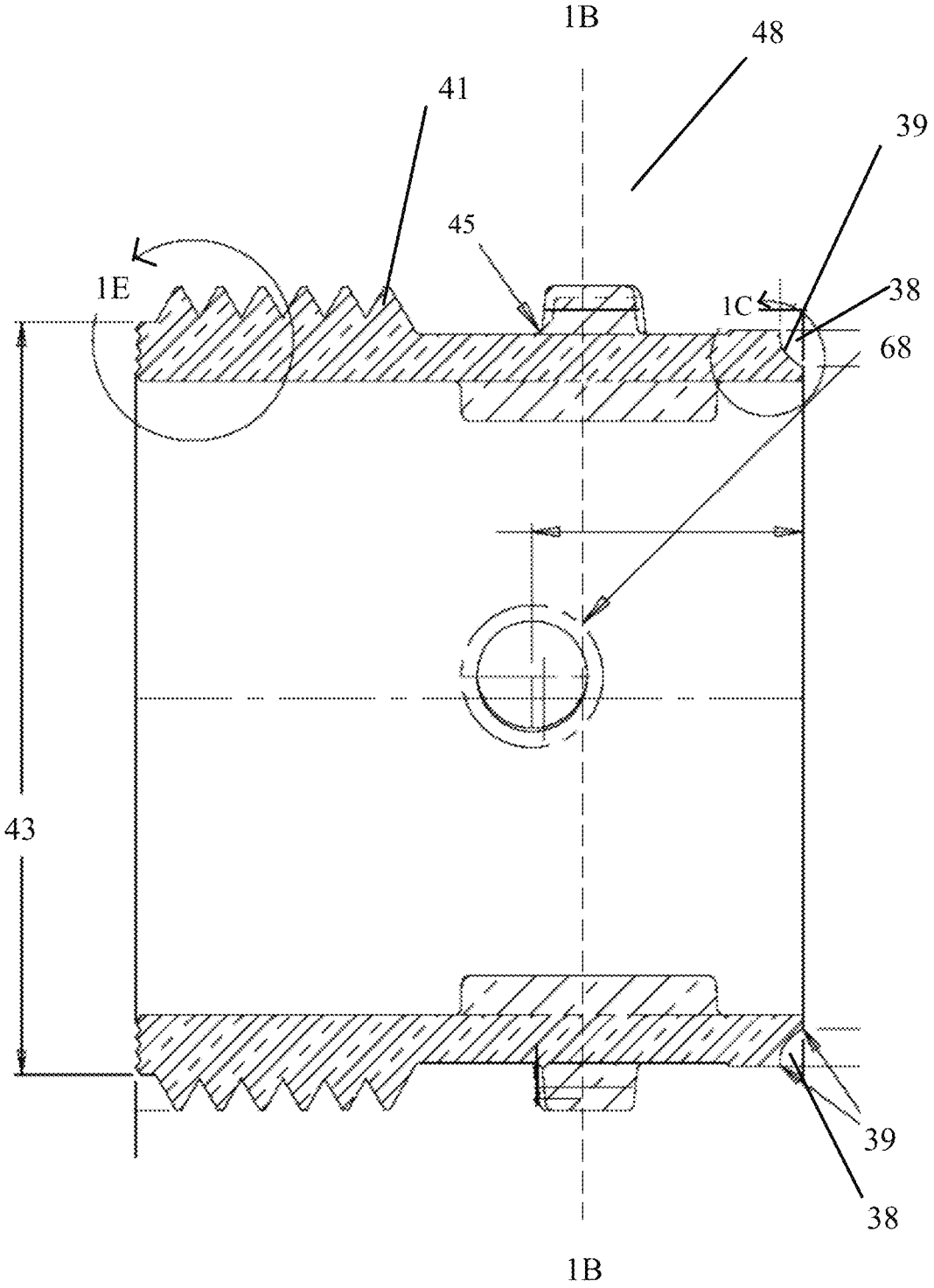
FIG. 1A shows a nozzle of a fire hydrant in an embodiment of the present invention.
Figure 1B:
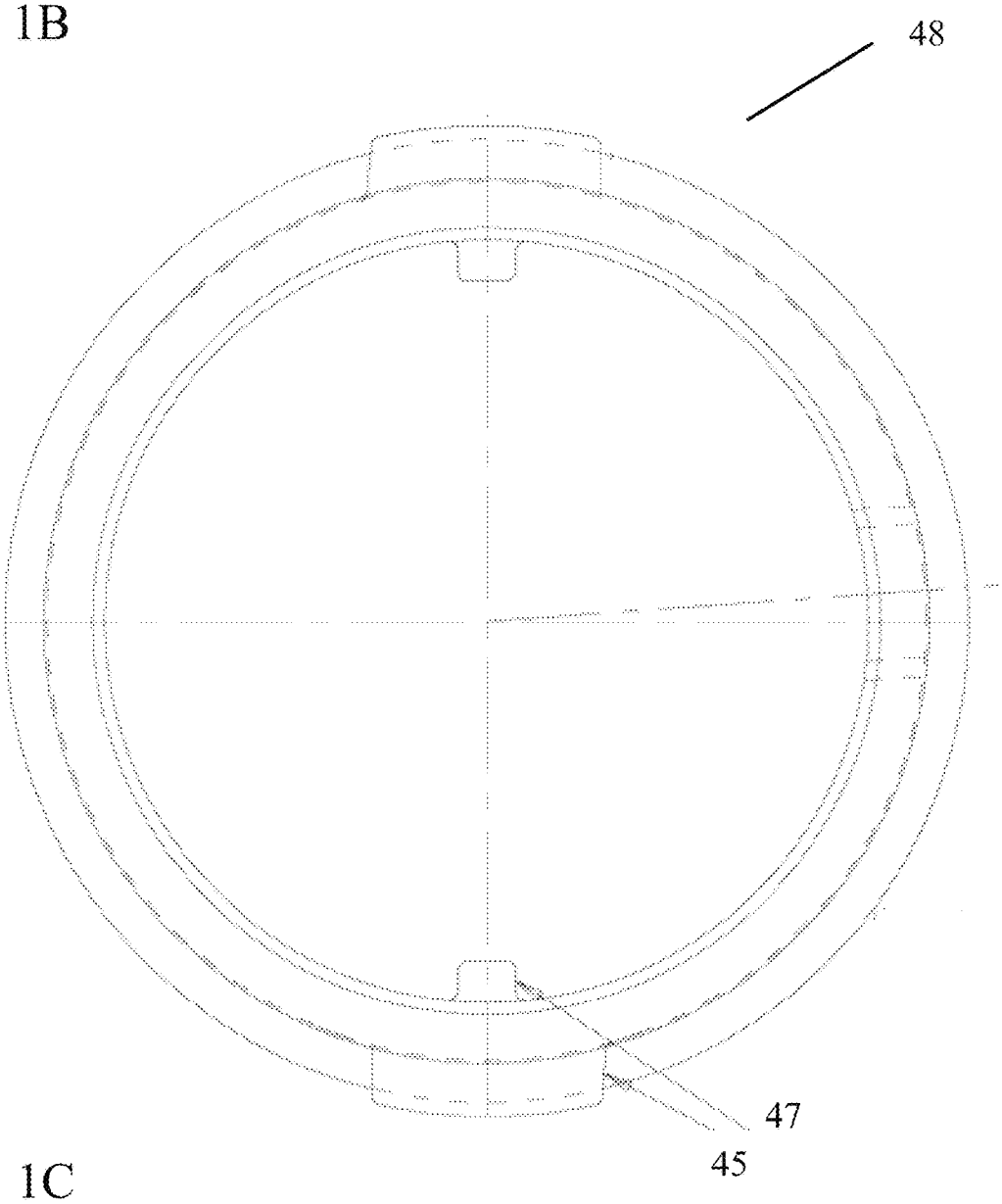
FIG. 1B shows a cross-sectional view into the interior of the nozzle along line 1B-1B of FIG. 1A.

The nozzle 48 includes a number of threads 41. Lugs 45, 47 or other connectors and a nozzle retaining screw 68 fasten the nozzle 48 to the upper barrel 58. FIG. 1B shows lining up of the interior lugs 47 with the exterior lugs 45.

The cup shaped capture nozzle housing 39 is curved to match the curve of the O-ring 38 with which it mates. The O-ring 38 and the capture nozzle housing 39 preferably have the same radius. The mating surfaces of the O-ring 38 and the capture nozzle housing 39 either match each other or are complementary to each other so that the two components create an effective seal.

Figure 1C:
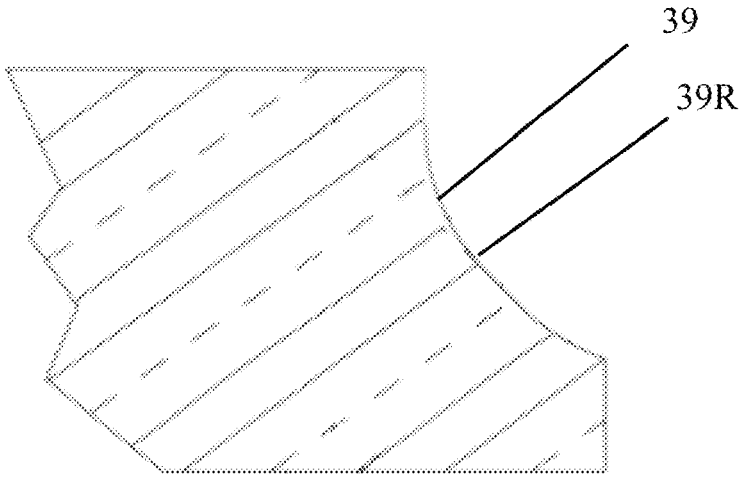
FIG. 1C shows a close up view of one of the capture nozzle housings with a single radius.

In one preferred embodiment, the capture nozzle housing 39 has a single radius 39R, as shown in FIG. 1C. One preferred radius 39R in this embodiment is 0.105 inches.

Figure 1D:
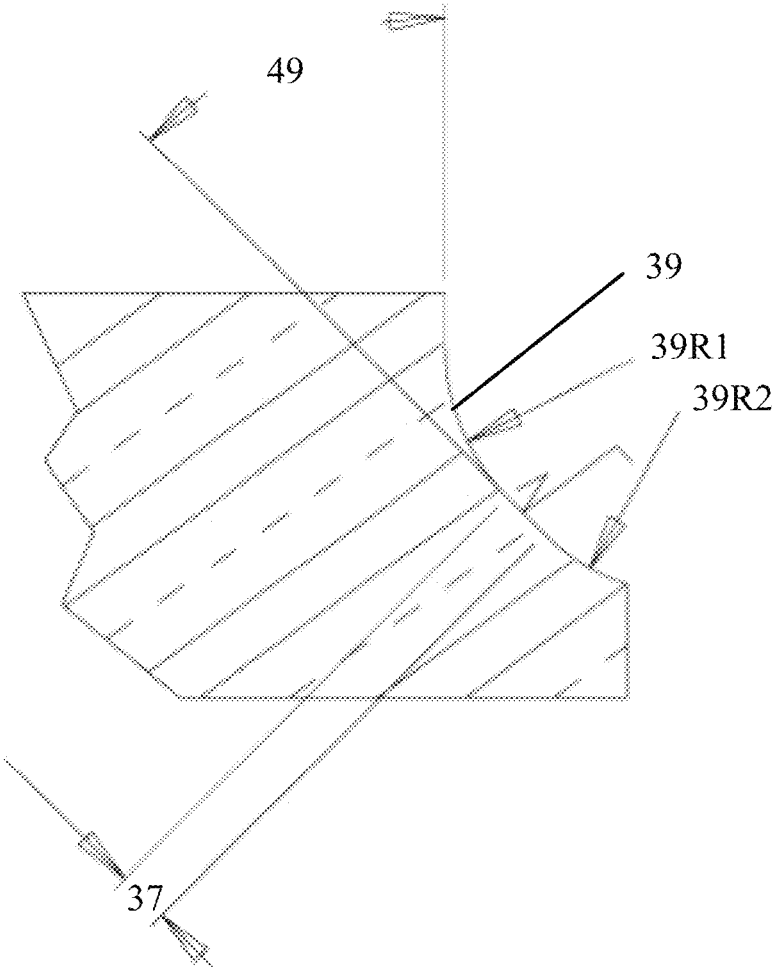
FIG. 1D shows a close up view of one of the capture nozzle housings with two radii and a flat between them.

In another preferred embodiment, there is a short flat portion 37 between two radii 39R1 and 39R2 of the capture nozzle housing 39, as shown in FIG. 1D. In this embodiment, the flat 37 forms an angle 49 tangent to the two radii 39 R1, 39R2. Some preferred dimensions for this embodiment include an angle 49 of 45 degrees, a flat 37 of 0.03 inches and radii 39R1 and 39R2 of 0.105 inches.

The capture nozzle housing 39 may have different dimensions, depending upon the fire hydrant and nozzle which with they are used. Other dimensions for a single radius 39R, or the two radii 39R1, 39R2, the flat 37 and the angle 49 may be used depending upon the type and size of the nozzle and O-rings.

Figure 1E:
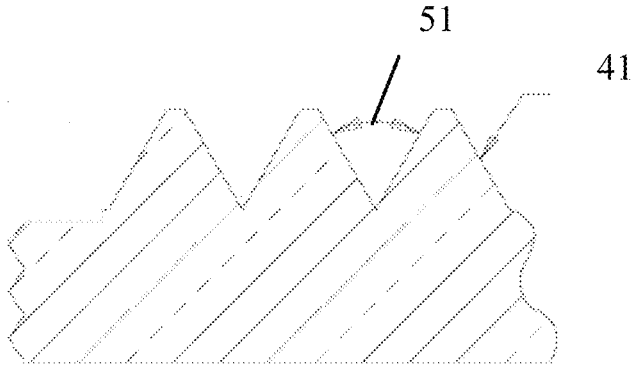
FIG. 1E shows a close up view of three threads of the nozzle.

FIG. 1E shows a close up view of three of the threads 41. In one preferred embodiment, the angle 51 formed between the threads 41 is 60 degrees. In another preferred embodiment, the angle 51 formed between the threads 41 is 55 degrees.

Figure 2A:
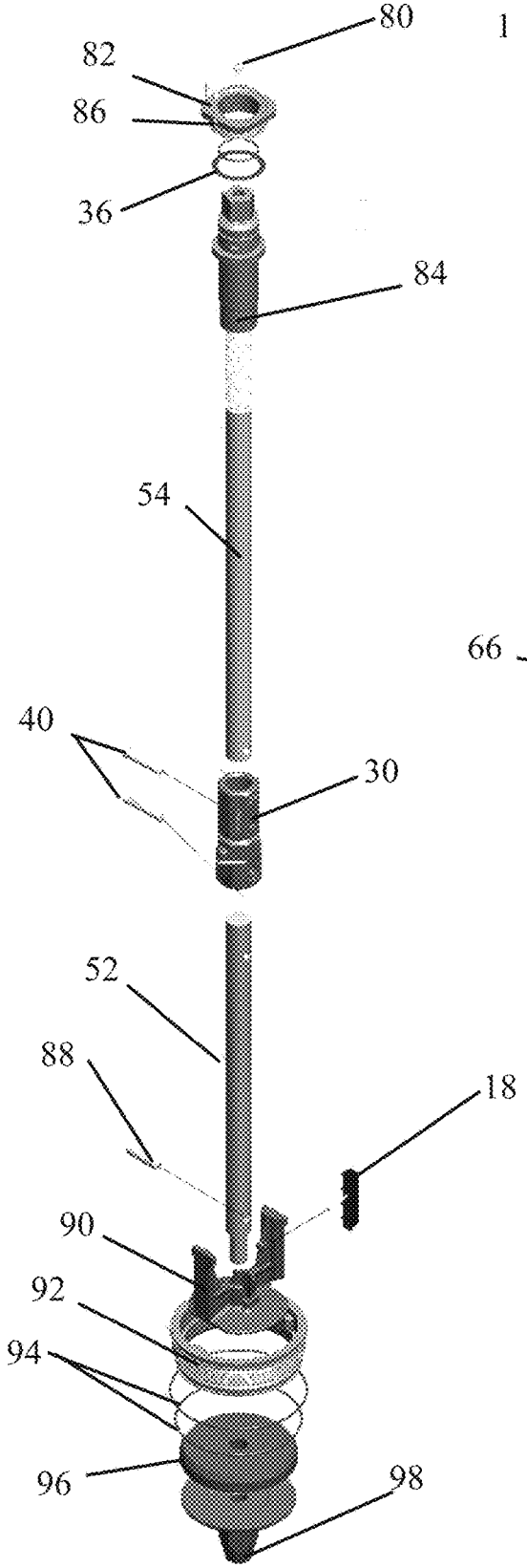
FIG. 2A shows interior components of a fire hydrant in an embodiment of the present invention.
Figure 2B:
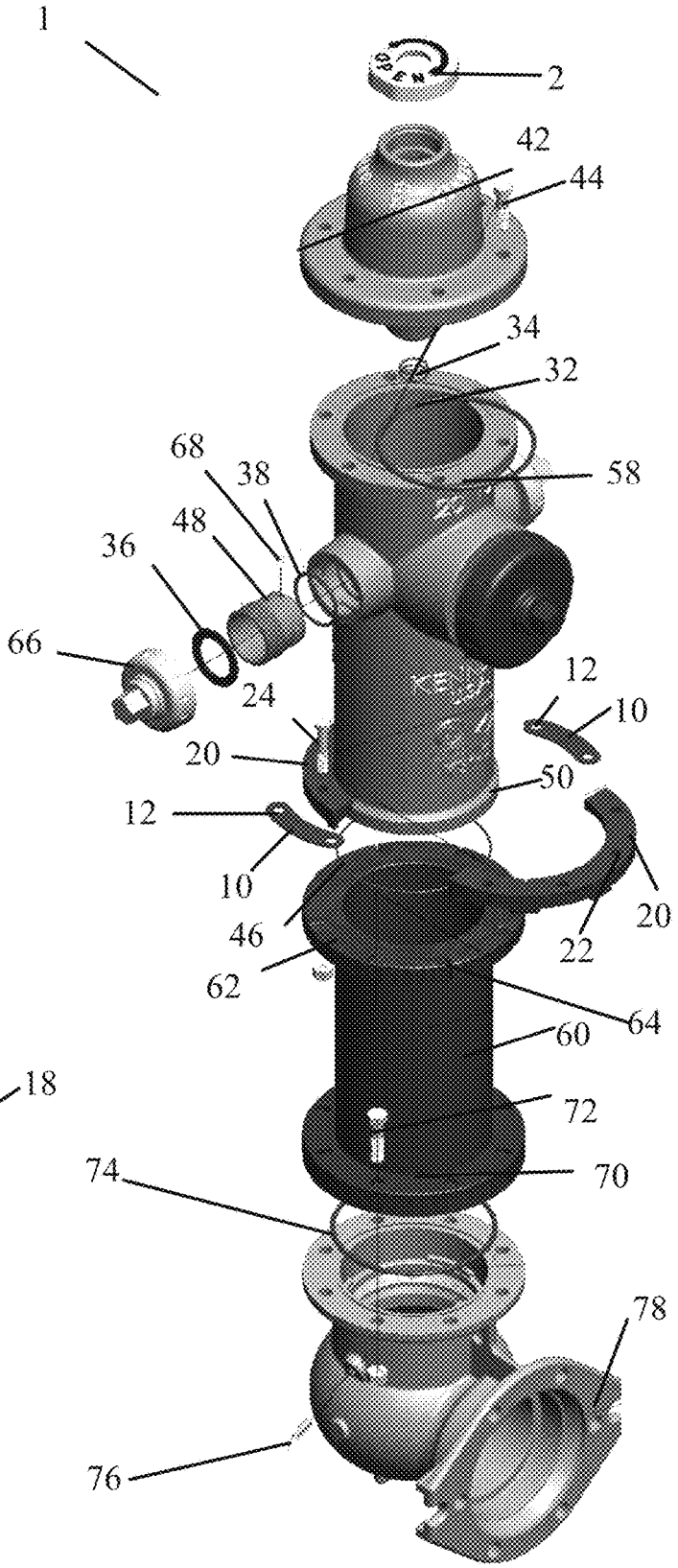
FIG. 2B shows exterior components of the fire hydrant of FIG. 2A.
Figure 3:
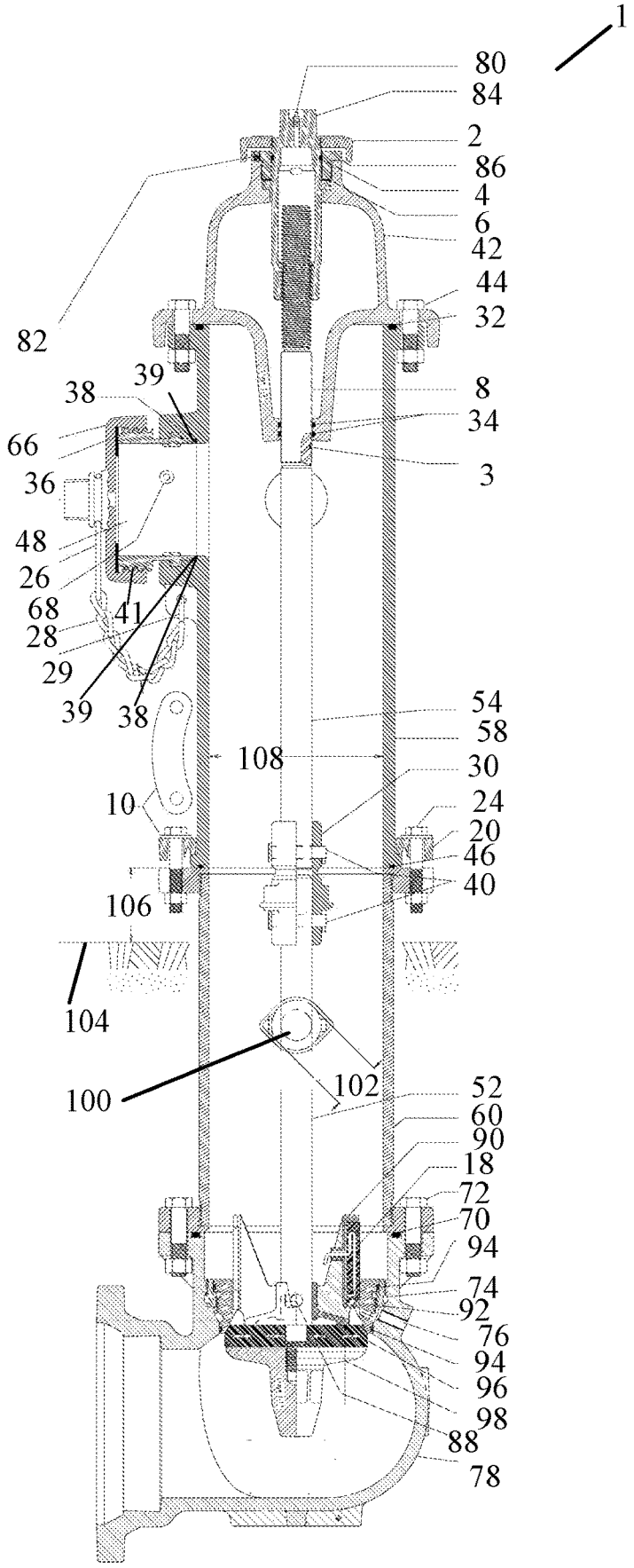
FIG. 3 shows a cross-sectional view of a fire hydrant in an embodiment of the present invention.
Figure 4:
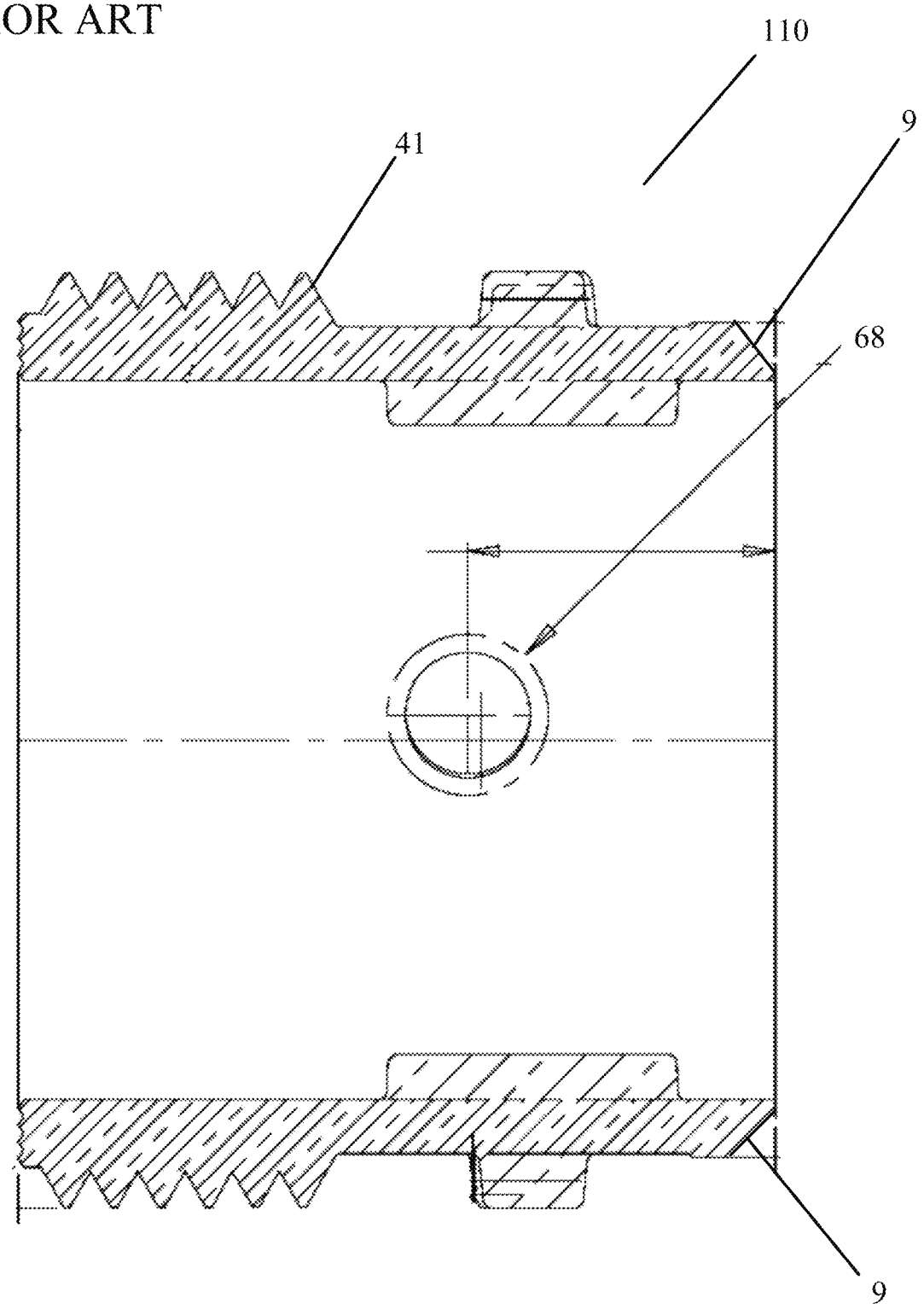
Fig. 4 PRIOR ART
FIG. 4 shows a partial view of a nozzle showing a prior art nozzle end.

FIGS. 2A, 2B and 3 show a fire hydrant 1 with the novel nozzle housing 39. The fire hydrant 1 includes a fitting 80, preferably made by Alemite LLC (St. Louis, Mo.), and a fastener 82, 86 such as an Allen head set screw 82 and a nut 86. A dirt shield 2 fits onto a hydrant cap 42. Cap fasteners 44, such as bolts and nuts, fasten the hydrant cap 42 to the upper barrel 58. The hydrant also includes an O-ring 34 and a hydrant cap gasket 32. A washer 6, for example a thrust washer, facilitates the connections in the cap portion of the fire hydrant. O-rings 3, 4 seal various portions of the fire hydrant 1.

An operating stem nut 84 connects the upper stem 54 to the cap portions of the fire hydrant 1. The upper stem 54 is located in the center of the upper barrel 58 and the lower stem 52 is located in the center of the lower barrel 60. An O-ring 46 creates a seal between the upper barrel 58 and the lower barrel 60. A stem ferrule, ring or cap 8 is preferably located on an upper end of the upper stem 54. A stem breaker coupling 30 is located between the upper stem 54 and the lower stem 52. The stems 52, 54 are fastened to the coupling 30 with coupling pins 40. The coupling 30 is preferably located directly above the ground line 104.

A bottom end view of the stem breaker coupling 100 and a wrench square 102 can be seen in FIG. 3. FIG. 3 also shows a distance 106 between the coupling 30 and the ground line 104. In some fire hydrants, this distance is approximately three inches. In some hydrants, the width 108 of the fire hydrant is 7 inches. Some preferred dimensions for the hydrant include a distance of approximately 18 inches between a center of the nozzle cap 66 and the ground line 104 and approximately 33½ inches between the ground line 104 and a top of the fire hydrant 1.

In some embodiments, there are two breaker straps 10 and two breaker rings 20. Each breaker strap 10 connects to the ends of the two breaker rings 20. The curve of the breaker straps 10 matches the curve of the breaker rings 20. The bolt or other fastener 24 goes through the holes 22 in the breaker ring 20, the holes 12 in the breaker strap 10, and into a hole 64 in the flange 62 of the lower barrel 60. The breaker straps 10 pick up the outer holes 22 in each side of the two half moon breaker rings 20.

The straps 10 under the head of the bolt or other fastener 24 keep the breaker rings 20 in place. This is similar to chain couplings in chain links. The breaker straps 10 are preferably made of metal, such as a sheet metal stamping. The ledge 50 is often tapered, for example beveled 15 degrees. With the breaker straps 10, the breaker rings 20 are able to better ride out the angle and the breaker straps 10 keep the breaker rings 20 in place.

While breaker straps 20 are shown in FIG. 3, in other embodiments, the hydrant 1 does not include the breaker straps 20. In those embodiments, the hydrant 1 still includes the other components (10, 30, 40) of the collision repair mechanism.

The hose nozzle 26 of the fire hydrant 1 includes a nozzle 48, an O-ring 38, a nozzle cap 66, a nozzle cap gasket 36, and a nozzle retaining screw 68. The nozzle 26 also preferably includes a nozzle cap chain 28 and a nozzle chain hook 29, for example an S-hook, which connects one end of the chain 28 to the body of the fire hydrant 1. As discussed above with respect to FIGS. 1A-1E, the nozzle 48 includes a nozzle cup 39 into which the O-ring 38 mates. Due to the rounded shape of the nozzle cup 39, the mating surface of the O-ring 38 matches the mating surface of the nozzle cup 39, providing the best alignment and seal between these two components 38, 39 of the nozzle 48.

An elbow 78 includes a seal 70 and fasteners 72. The fire hydrant 1 also includes a drain tube 76. A drain valve 90 includes a drain valve pin 88, and a drain valve facing with inserts 18. A seat ring 92 includes a seat ring insert 74. Seals, such as O-rings 94, seal the seat ring 92 to the main valve 96. A bottom plate 98 sits within the elbow 78. In FIG. 3, the drain holes in the drain tube 76 are shown rotated 90 degrees. The elbow (shoe) 78 and bottom plate 98 are preferably epoxy coated in accordance with regulations.

While a specific design for a fire hydrant 1 is shown in the figures, other fire hydrant models that use a nozzle and O-ring could use the nozzle cup 39 described herein. Alternatively, the nozzle cup 39 may be used on a nozzle for a gate valve.

| Reference Numeral List: | |
|---|---|
| 1 | hydrant |
| 2 | dirt shield |
| 3 | O-ring |
| 4 | O-ring |
| 6 | washer |
| 8 | stem ferrule |
| 9 | nozzle chamfer |
| 10 | breaker strap |
| 12 | breaker strap |
| 14 | breaker strap top |
| 16 | breaker strap bottom |
| 18 | drain valve facing with insert |
| 20 | breaker ring |
| 22 | breaker ring outer holes |
| 24 | breaker ring bolts |
| 26 | hose nozzle |
| 28 | nozzle cap chain |
| 29 | nozzle chain S hook |
| 30 | stem breaker coupling |
| 32 | hydrant cap gasket |
| 34 | O-rings |
| 36 | nozzle cap gasket |
| 37 | flat |
| 38 | O-rings in nozzle |
| 39 | O-ring capture nozzle housing |
| 39R | capture nozzle housing radius |
| 39R1 | capture nozzle housing radius |
| 39R2 | capture nozzle housing radius |
| 40 | coupling pins |
| 41 | nozzle threads |
| 42 | cap |
| 43 | nozzle diameter |
| 44 | cap fasteners |
| 45 | lugs |
| 46 | O-ring |
| 47 | interior |
| 48 | nozzle |
| 49 | angle formed by capture nozzle housing |
| 50 | ledge |
| 51 | angle formed between threads |
| 52 | lower stem |
| 54 | upper stem |
| 58 | upper barrel |
| 60 | lower barrel |
| 62 | flange on lower barrel |
| 64 | holes on flange |
| 66 | nozzle cap |
| 68 | nozzle retaining screw |
| 70 | elbow seal |
| 72 | elbow fasteners |
| 74 | seat ring insert |
| 76 | drain tube |
| 78 | elbow |
| 80 | fitting |
| 82 | screw |
| 84 | operating stem nut |
| 86 | stem lock nut |
| 88 | drain valve pin |
| 90 | drain valve |
| 92 | seat ring |

-continued

| Reference Numeral List: | |
|---|---|
| 94 | O-ring |
| 96 | main valve |
| 98 | bottom plate |
| 100 | bottom end view of breaker coupling |
| 102 | wrench square |
| 104 | ground line |
| 106 | distance to ground |
| 108 | hydrant width |
| 110 | hose nozzle |

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A hose nozzle for a fire hydrant comprising at least one O-ring, the hose nozzle comprising:

a cylindrical housing including a first end, a second end, and a plurality of threads in proximity to the first end, wherein a first radius of the second end matches a radius of the O-ring, such that a first mating surface of the second end is complementary to a second mating surface of the O-ring, wherein the first radius of the second end intersects an axially endmost surface of the cylindrical housing and a radially outermost surface of the second end of the cylindrical housing.

2. The hose nozzle of claim 1, wherein the first radius is approximately 0.105 inches.

3. A hose nozzle for a fire hydrant comprising at least one O-ring, comprising:

a cylindrical housing including a plurality of threads in proximity to a first end of the housing and a curved second end, wherein a first radius of the curved second end matches a radius of the O-ring, such that a first mating surface of the curved second end is complementary to a second mating surface of the O-ring, the curved second end including a second radius and a flat portion between the first radius and the second radius, such that the flat portion forms a 45 degree angle tangent to the first radius and the second radius.

4. The hose nozzle of claim 1, wherein the axially endmost surface is endmost in a direction along an axis of symmetry of the cylindrical housing.

5. The hose nozzle of claim 3, wherein the curved second end includes an extremity of the cylindrical housing in a direction parallel to a center axis of the cylindrical housing.

6. The hose nozzle of claim 5, wherein the center axis is an axis of symmetry of the cylindrical housing.

7. The hose nozzle of claim 3, wherein the curved second end includes a concave chamfer.

* * * * *